US008291656B2

(12) United States Patent
Gunther et al.

(10) Patent No.: US 8,291,656 B2
(45) **Date of Patent: *Oct. 23, 2012**

(54) RETENTION ASSEMBLY FOR RETAINING A PANEL IN A WINDOW OR A DOOR

(75) Inventors: Peter A. Gunther, Cullom, IL (US); Robert E. Daniels, Jr., Fairbury, IL (US)

(73) Assignee: Quanex Corporation, Houston, TX (US)

( * ) Notice: Subject to any disclaimer, the term of this patent is extended or adjusted under 35 U.S.C. 154(b) by 39 days.

This patent is subject to a terminal disclaimer.

(21) Appl. No.: 12/792,985

(22) Filed: Jun. 3, 2010

(65) Prior Publication Data

US 2010/0300036 A1 Dec. 2, 2010

Related U.S. Application Data

(63) Continuation of application No. 11/484,826, filed on Jul. 11, 2006, now Pat. No. 7,752,816.

(60) Provisional application No. 60/698,253, filed on Jul. 11, 2005.

(51) Int. Cl.
*E06B 1/04* (2006.01)
*E06B 3/964* (2006.01)
*E06B 3/988* (2006.01)

(52) U.S. Cl. ..... 52/204.66; 52/214; 52/204.62; 52/204.7

(58) Field of Classification Search ..... 52/203, 52/204.55, 214, 204.591, 204.599, 204.62, 52/204.66, 204.7, 204.72, 204.1, 204.5, 213, 52/204.54, 204.64, 204.69, 656.5, 656.6
See application file for complete search history.

(56) References Cited

U.S. PATENT DOCUMENTS

| | | | | |
|---|---|---|---|---|
| 1,888,535 | A | 11/1932 | Krueger et al. | |
| 2,124,353 | A | 7/1938 | Plym | |
| 2,166,361 | A * | 7/1939 | Lowry | 52/769 |
| 2,268,269 | A | 12/1941 | Toney et al. | |
| 2,497,515 | A | 2/1950 | Pearse | |
| 2,807,339 | A | 9/1957 | Wagner | |
| 2,902,727 | A * | 9/1959 | Samolis | 52/204.54 |
| 3,112,534 | A | 12/1963 | Winnan | |
| 3,125,191 | A | 3/1964 | Singer et al. | |
| 3,201,831 | A * | 8/1965 | Cudini | 52/204.54 |
| 3,212,225 | A * | 10/1965 | Neal | 52/769 |
| 3,242,627 | A | 3/1966 | Fountain | |

(Continued)

FOREIGN PATENT DOCUMENTS

GB 2141165 A * 12/1984

*Primary Examiner* — Joshua J Michener
*Assistant Examiner* — Ryan Kwiecinski
(74) *Attorney, Agent, or Firm* — Howard & Howard Attorneys PLLC

(57) ABSTRACT

A retention assembly is for retaining a panel in a window or a door. The assembly includes a surround, a frame, and a locking latch. The surround includes a first and a second pair of spaced segments which extend to define an opening. The frame includes a pair of first spaced sides and the panel is supported between the sides. The pair of first spaced sides are disposed between the first and second pair of segments. One of the first sides includes a floor and a catch which extends from the floor. The locking latch is movably supported by the surround and defines a retention recess for permitting locking engagement between the locking latch and the catch as the locking latch is moved relative to one of the first segments.

26 Claims, 5 Drawing Sheets

U.S. PATENT DOCUMENTS

| | | | | |
|---|---|---|---|---|
| 3,256,668 | A | 6/1966 | Downes | |
| 3,381,434 | A * | 5/1968 | Carson | 52/204.591 |
| 4,106,239 | A * | 8/1978 | Bancroft et al. | 49/449 |
| 4,133,366 | A | 1/1979 | Jenkins, Sr. | |
| 4,187,657 | A * | 2/1980 | Sukolics | 52/204.591 |
| 4,376,359 | A * | 3/1983 | Redman | 52/127.1 |
| 5,095,676 | A * | 3/1992 | Muhle | 52/476 |
| 6,073,675 | A | 6/2000 | Dannaher | |
| 6,105,333 | A | 8/2000 | Meesemaecker et al. | |
| 6,502,356 | B2 | 1/2003 | Emek | |
| 6,530,184 | B1 * | 3/2003 | Emek | 52/204.591 |
| 6,769,214 | B1 | 8/2004 | Kenkel et al. | |
| 7,040,062 | B2 * | 5/2006 | Emek | 52/204.62 |

* cited by examiner

FIG - 7
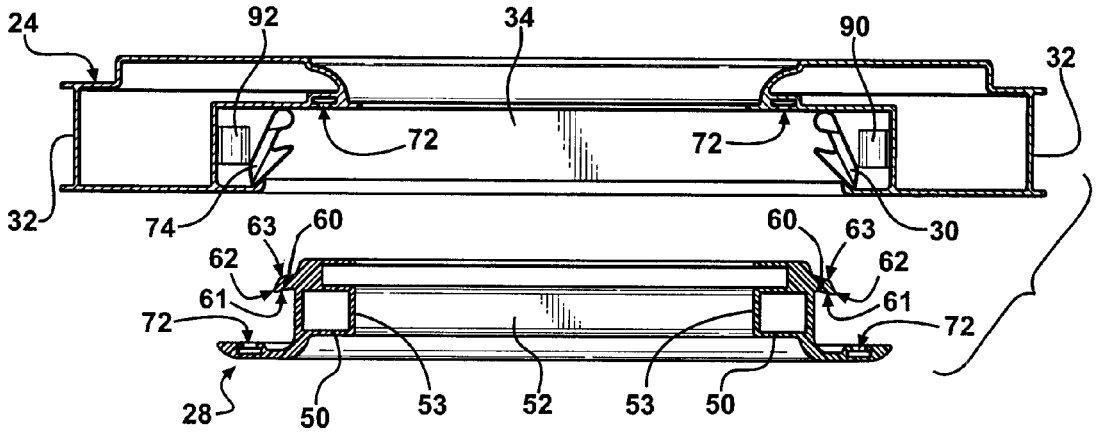
FIG - 8
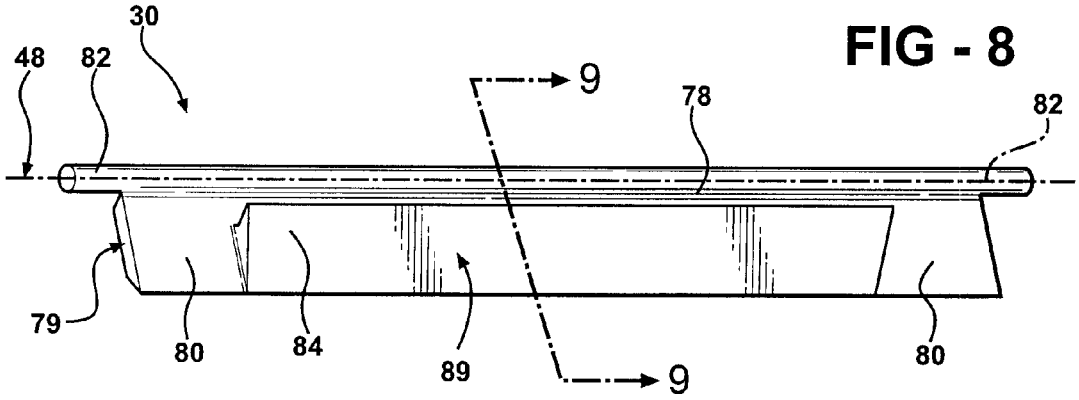
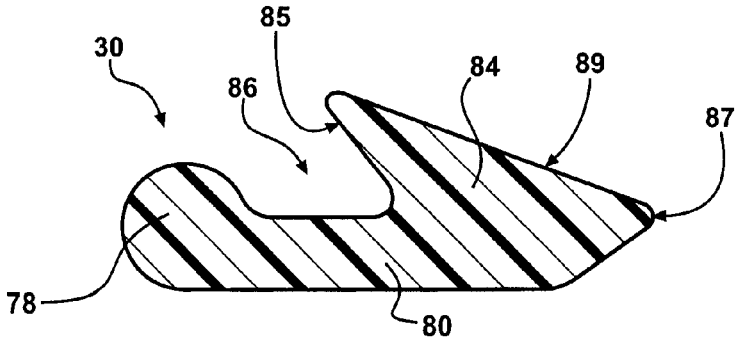
FIG - 9

RETENTION ASSEMBLY FOR RETAINING A PANEL IN A WINDOW OR A DOOR

CROSS REFERENCE TO RELATED APPLICATION

This application claims the benefit of U.S. patent application Ser. No. 11/484,826 filed on Jul. 11, 2006, which claims the benefit of U.S. Provisional Patent Application No. 60/698,253 filed on Jul. 11, 2005, both of which are incorporated herein by reference.

BACKGROUND OF THE INVENTION

1. Field of the Invention

The invention generally relates to a retention assembly for retaining a panel to a window or a door.

2. Description of the Related Art

Traditional windows or doors include a surround which defines an opening. A panel, such as a pane of glass or a screen cloth, is typically bounded by a frame. The frame is attached to the window or the door so that the panel covers the opening. To secure the frame to the surround, a fastener is typically inserted through a bracket and the fastener is threaded into the surround at a plurality of locations. Tightening the fastener forces the bracket against the frame to clamp and hold the frame to the surround in the window or the door. Although the panel covers the opening, this also means that the fasteners and the brackets remain visible. Additionally, the fasteners and brackets can become loose, causing the frame to rattle between the surround and the brackets.

To eliminate the need for the fasteners and the brackets, U.S. Pat. No. 6,769,214 to Kenkel et al. discloses a surround disposed in a door and a frame concentric to, and removably engaged in, the surround. The frame includes a first pair of sides and a second pair of sides extending perpendicular to the first pair of sides. Each pair of sides extends in spaced and parallel relationship to border the panel.

The surround includes first a pair of segments and a second pair of segments extending perpendicular to the first pair of segments. Each pair of segments are in spaced and parallel relationship and define an opening in the door. Each of the first segments have a cross-section which includes a base wall and a pair of retention walls extending from the base wall in spaced and parallel relationship to define a C-shaped channel. Each retention wall defined a retention notch. A retainer is removably disposed in each of the C-shaped channels. Each retainer includes a pair of ribs corresponding to the respective retention notch. The ribs are smaller than the retainer notches for slidably engaging the corresponding retention notch when the retainer is inserted into the C-shaped channel. This allows the retainers to slide within the C-shaped channels. A pair of flexible fingers extend from each retainer and act as springs to contact and flex against the corresponding base wall. Each retainer also defines a slot, opposite the flexible fingers and facing the opening, for receiving and cradling the first side to the surround.

The frame, with the panel affixed, is assembled to the surround by inserting one of the first sides into the slot of one of the first segments of the surround and forcing the retainer toward the base wall by flexing the fingers. The frame is tilted to cover the opening and align the other one of the first sides with the slot of the other one of the first segments at which time the frame is released. Once the force is no longer applied to the retainer, the flexed fingers push against the base wall and move the retainer within the C-shaped channel and away from the base wall. As a result, the retainers in both of the first segments are continuously pushed away from their respective base walls, toward each other, to retain the frame to the surround. However, as the first sides of the frame are loosely cradled by the respective slots, the frame is not prevented from rattling within the surround and leaks of air, water, and/or debris are not prevented between the frame and the surround.

Accordingly, it would be advantageous to provide a retainer for retaining a panel to a window or a door which does not require the use of fasteners while still grasping or interlocking with the panel. Fasteners can loosen over time and may be considered by some to be unsightly. Additionally, extra time and expense are required to assemble the fasteners to retain the panel to the window.

SUMMARY OF THE INVENTION AND ADVANTAGES

The present invention is a retention assembly for retaining a panel in a window or a door. The assembly comprises a surround, a frame, and a locking latch. The surround includes a pair of first spaced segments and a pair of second spaced segments with the first segments extending relative to the second segments to define an opening. The frame is for supporting the panel and includes a pair of first spaced sides for disposition of the frame within the first and second segments. One of the first sides of the frame presents a cross-section which includes a floor and a cantilevered catch extending from the floor. The locking latch is movably supported by the surround and extends in spaced relationship to one of the first segments. The locking latch presents a cross-section and defines a retention recess for permitting locking engagement between the catch and the locking latch when the locking latch is moved relative to the one of the first segments.

By moving the locking latch relative to the one of the first segments to engage the catch within the retention recess, the frame is essentially interlocked with the surround via the locking latch. Locking the frame to the surround provides a secure fit between the frame and the surround which also prevents rattling of the frame with respect to the surround. In addition, use of a locking latch eliminates the use of multiple fasteners which reduces the cost to assemble the frame to surround while also improving the overall appearance when the panel is assembled to the window or the door. This means that the locking latch remains hidden between the sides of the frame and the segments of the surround which maintains a clean look.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 7 is a cross-sectional view of the frame detached from the surround taken along line 7-7 of FIG. 2;

FIG. 8 is a perspective view of the locking latch;

FIG. 9 is a cross-sectional view of the locking latch taken along line 9-9 of FIG. 8;

DETAILED DESCRIPTION OF THE INVENTION

Figure 1:
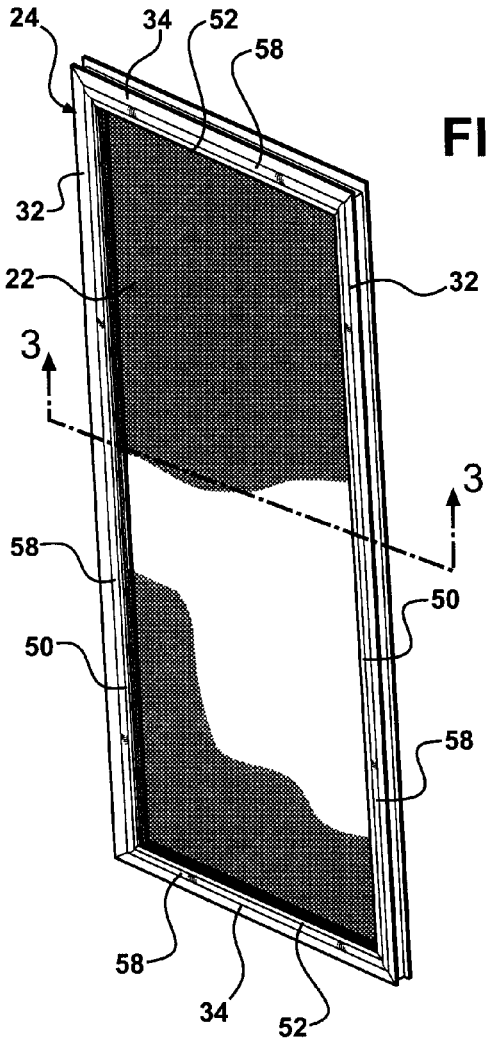
FIG. 1 is a perspective view of a frame assembled to a surround.

The present invention is a retention assembly for retaining a panel in a window or a door. The assembly is shown generally at 20 in FIG. 4 and includes a surround 24 defining an opening 26, a frame 28 for supporting the panel 22 to cover the opening 26, and a locking latch 30 for retaining the frame 28 to the surround 24.

Figure 2:
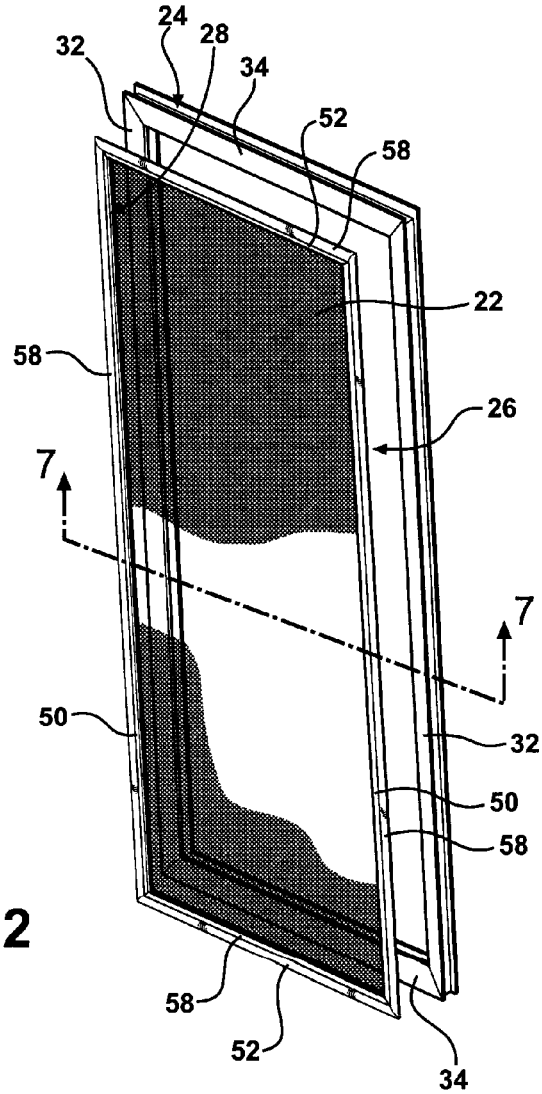
FIG. 2 is a perspective view illustrating the frame detached from the surround.
Figure 4:
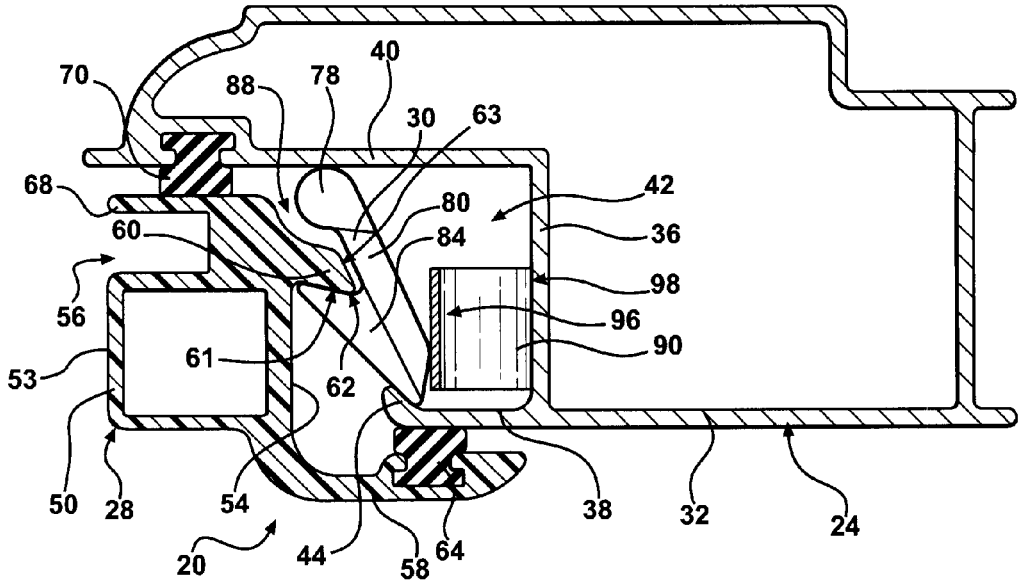
FIG. 4 is a cross-sectional view of 4 of FIG. 3 showing the retention assembly.

The surround 24 is typically placed into a hole which is formed in the window or the door. The surround 24 is preferably a rectangular or square shape, but it should be appreciated that the present invention is not limited to being used with these shapes. For example, the surround 24 may make up an octagonal shape. Referring generally to FIGS. 1-2, the surround 24 includes a pair of first segments 32 which extend vertically and a pair of second segments 34 which extend horizontally. Each pair of segments 32, 34 extend in spaced and parallel relationship to one another. In addition, the pair of first segments 32 preferably extend in perpendicular relationship to the pair of second segments 34 to define the opening 26. However, the second segments 34 may extend at another angle relative to the first segments 32 to define the opening 26 so long as the function of the present invention is not prevented. The segments 32, 34 may be extruded, roll formed, or formed in any desired manner. Referring generally to FIG. 4, the segments 32, 34 present a cross-section which includes a base wall 36 which faces the opening 26. Although the cross-section depicted in FIG. 4 is taken through the first segment 32, it should be appreciated that the cross-section of the second segment 34 may be the same as that shown for the first segment 32. A retention wall 38 and a mounting wall 40 extend in perpendicular relationship to the base wall 36. The retention wall 38 the mounting wall 40, and the base wall 36 define a cavity 42. On the first segments 32, a retention lip 44 extends from the retention wall 38 and curves toward the cavity 42. However, the retention lip 44 may also be formed on the second segments 34 if it is desired. It should be appreciated that the first pair of spaced segments 32 are not limited to extending vertically and the second pair of spaced segments 34 are not limited to extending horizontally.

Figure 6:
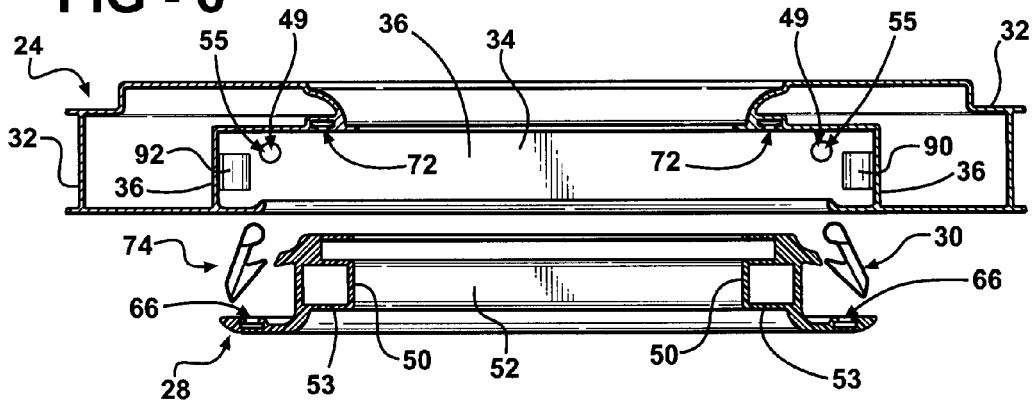
FIG. 6 is an exploded cross-sectional view of the frame and surround of FIG. 3 including the pair of locking latches for disposition in pivot holes defined in the surround for retaining the frame to the surround.
Figure 10:
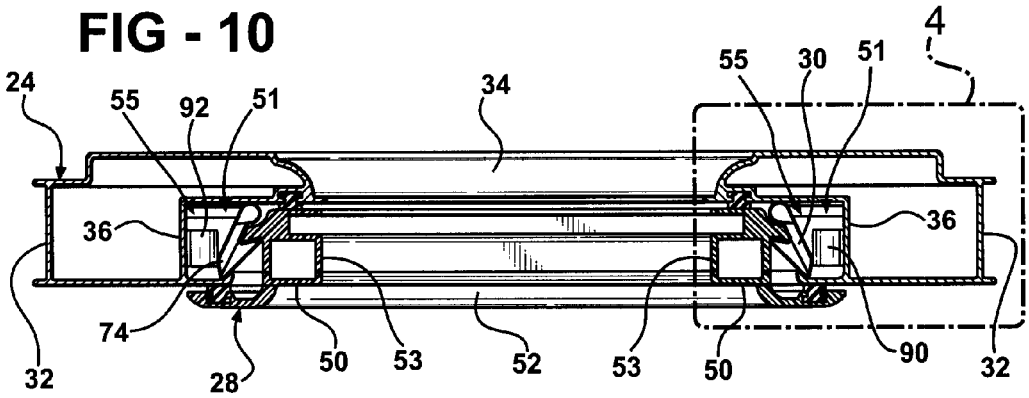
FIG. 10 is a cross-sectional view of the frame assembled to the surround, taken along line 3-3 of FIG. 1, showing a pair of retention assemblies for retaining the frame to the surround in an alternative embodiment.
Figure 11:
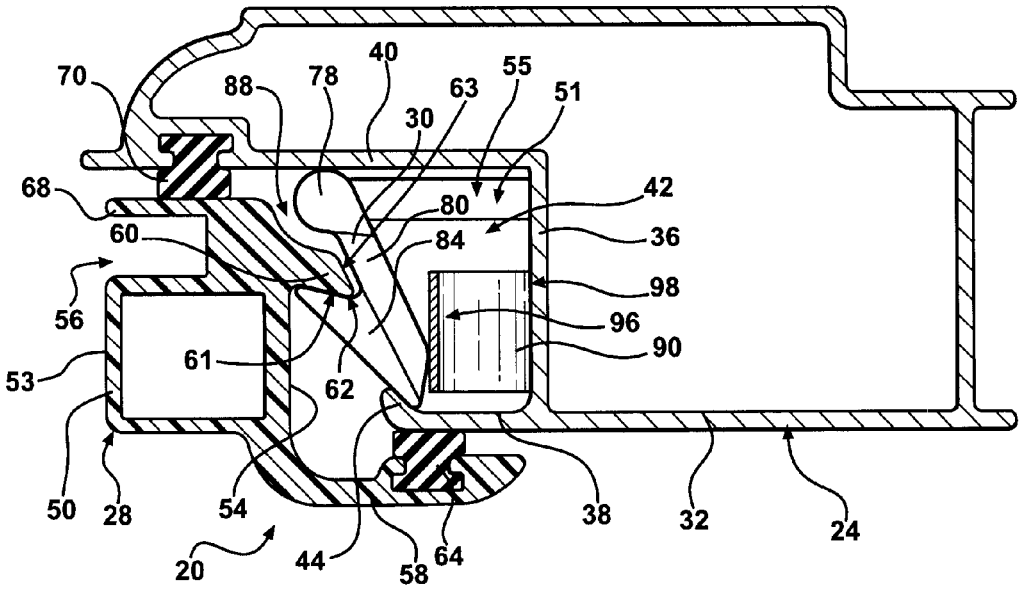
FIG. 11 is a cross-sectional view of 4 of FIG. 10 showing the retention assembly of the alternative embodiment.
Figure 12:
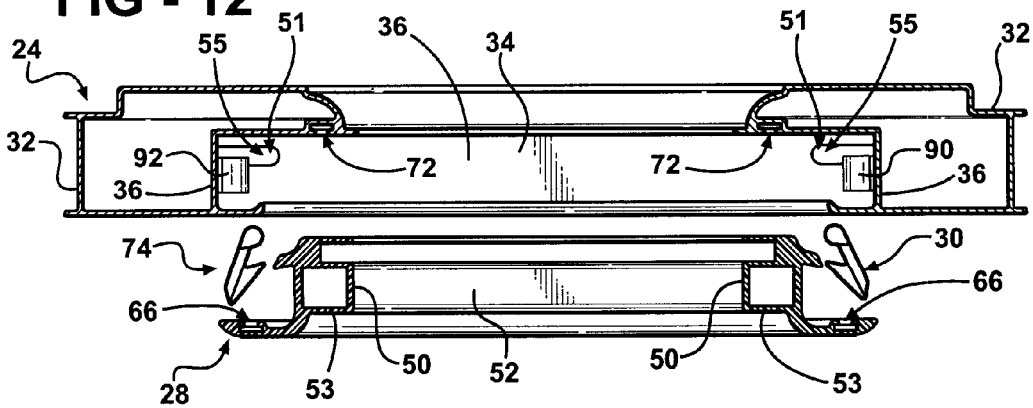
FIG. 12 is an exploded cross-sectional view of the alternative embodiment of the frame and surround of FIG. 10 including the pair of locking latches disposed in slots defined in the surround for retaining the frame to the surround.

Referring now to FIGS. 6 and 12, each base wall 36 of the second segments 34 preferably defines two opposing apertures 55 which face the opening 26 and are spaced from the respective first segment 32. The apertures 55 may be pivot holes 49, as shown in FIG. 6, or slots 51, as shown in FIGS. 10-12. This means that there are typically two pair of apertures 55. When the apertures 55 are pivot holes 49, each pair of pivot holes 49 are aligned along a respective axis 48, 76 which extends in spaced and parallel relationship to the respective first segment 32 through the respective cavity 42. The pivot holes 49 or slots 51 are preferably defined by the base wall 36. However, it should be appreciated that the pivot holes 49 should not be limited to being pivot holes 49, but may be any desired feature which allows rotation of the locking latch 30, e.g., pins, etc. Additionally, the pivot holes 49 do not have to be included on the base wall 36 of the second segments 34 or on the second segments 34 at all. For example, the pivot holes 49 may be formed on/in any other part of the second segments 34. Alternatively, the pivot holes 49 may be formed on/in a portion of the first segments 32, so long as the pivot holes 49 and the respective axis 48, 76 are aligned to extend through the respective cavity 42.

The frame 28 is for supporting the panel 22. It should be appreciated that the panel 22 may be formed of any desired material for covering the opening 26, e.g., screen cloth, glass, fabric, etc. The frame 28 includes a first pair of spaced sides 50 for disposition of the frame 28 within the first pair and the second pair of spaced segments 32, 34. Additionally, the frame 28 preferably includes a second pair of spaced sides 52 which extend in perpendicular relationship to the first pair of spaced sides 50. However, the second pair of sides 52 are not limited to being parallel to the first sides 50 as they may extend at any desired angle, preferably to match the opening 26 defined by the surround 24. The sides 50, 52 may be extruded, roll formed, or formed in any desired manner. Referring again to FIG. 4, the sides 50, 52 are typically formed from a tubular member 53 which helps provide structural rigidity to the sides 50, 52. However, the tubular member 53 is not required. A cross-section of the tubular member 53 may be any shape, but is typically square. Although the cross-section depicted in FIG. 4 is taken through the first side 50, it should be appreciated that the cross-section of the second side 52 may be the same as that shown for the first side 50. The sides 50, 52 present a cross-section which includes a floor 54 which extends along the tubular member 53. The sides 50, 52 define a groove 56 for receiving and supporting the panel 22. The groove 56 extends perpendicular to the floor 54 and opens in a direction opposite the floor 54. The groove 56 also extends along the tubular member 53. Additionally, the tubular member 53 acts to hide where the panel 22 is attached to the sides 50, 52. It should be appreciated that the groove 56 may extend in any direction or from any portion of the side 50, 52 for receiving and supporting the panel 22. The groove 56 is not required and the panel 22 may be attached to the frame 28 in any manner desired. A flange 58 extends from the floor 54. On the first sides 50, a catch 60 extends from the floor 54 in spaced relationship to the flange 58. The catch 60 may be any shape which facilitates engagement with the locking latch 30. Typically, the catch 60 extends from the floor 54 in a cantilevered fashion. The catch 60 generally tapers and extends to a point 62. The catch 60 includes a retention surface 61 which extends from the floor 54 to the point 62. The catch 60 also includes a ramp surface 63 which extends from the floor to the point 62. Typically, the retention surface 61 extends at an acute angle relative to the floor 54 to facilitate locking engagement with the locking latch 30, which will be described in more detail below. The ramp surface 63 is for sliding along the locking latch 30 when assembling the frame 28 to the surround 24, which will also be described in more detail below. When the frame 28 is disposed over the opening 26 and between the first and the second spaced segments 32, 34, the flange 58 extends in spaced relationship to the retention wall 38 of the corresponding segment 32, 34. This means that the first seal 64 preferably touches and becomes sandwiched between the flange 58 and the retention wall 38. A first seal 64 is disposed between the flange 58 and the retention wall 38 when the frame 28 is disposed over the opening 26 and between the first and the second spaced segments of the surround 24. The first seal 64 not only prevents leakage of air, water, or other particles, but it helps prevent the frame 28 from rattling or scraping with respect to the surround 24. The flange 58 defines a first recess 66 for receiving and retaining the first seal 64. However, the first recess 66 is not required and the first seal 64 may be retained between the flange 58 and the retention wall 38 in any other preferred configuration.

The first and second sides 52 each include a support wall 68 which extends in a direction opposite from the flange 58. If the side is the first side 50, the support wall 68 extends from the floor 54 in a direction opposite from the catch 60 and the flange 58 and the catch 60 are disposed between the support wall 68 and the flange 58. When the frame 28 is disposed between the first and the second spaced segments 32, 34, the support wall 68 extends in spaced relationship to the mounting wall 40 and a second seal 70 is preferably disposed between the mounting wall 40 and the support wall 68. The second seal 70 preferably touches and becomes sandwiched between the mounting wall 40 and the support wall 68. Similar to the first seal 64, the second seal 70 helps to prevent leakage of air, water, or other particles and also helps to prevent rattling of the frame 28 with respect to the surround 24. The mounting wall 40 defines a second recess 72 for receiving and retaining the second seal 70. However, the second recess 72 is not required and the second seal 70 may be retained between the support wall 68 and the mounting wall 40 in any other preferred configuration.

Figure 3:
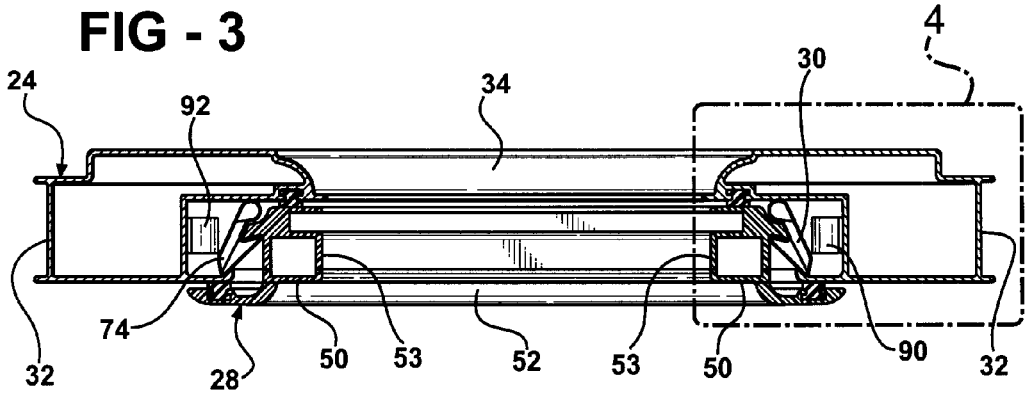
FIG. 3 is a cross-sectional view of the frame assembled to the surround, taken along line 3-3 of FIG. 1, showing a pair of retention assemblies for retaining the frame to the surround.
Figure 5:
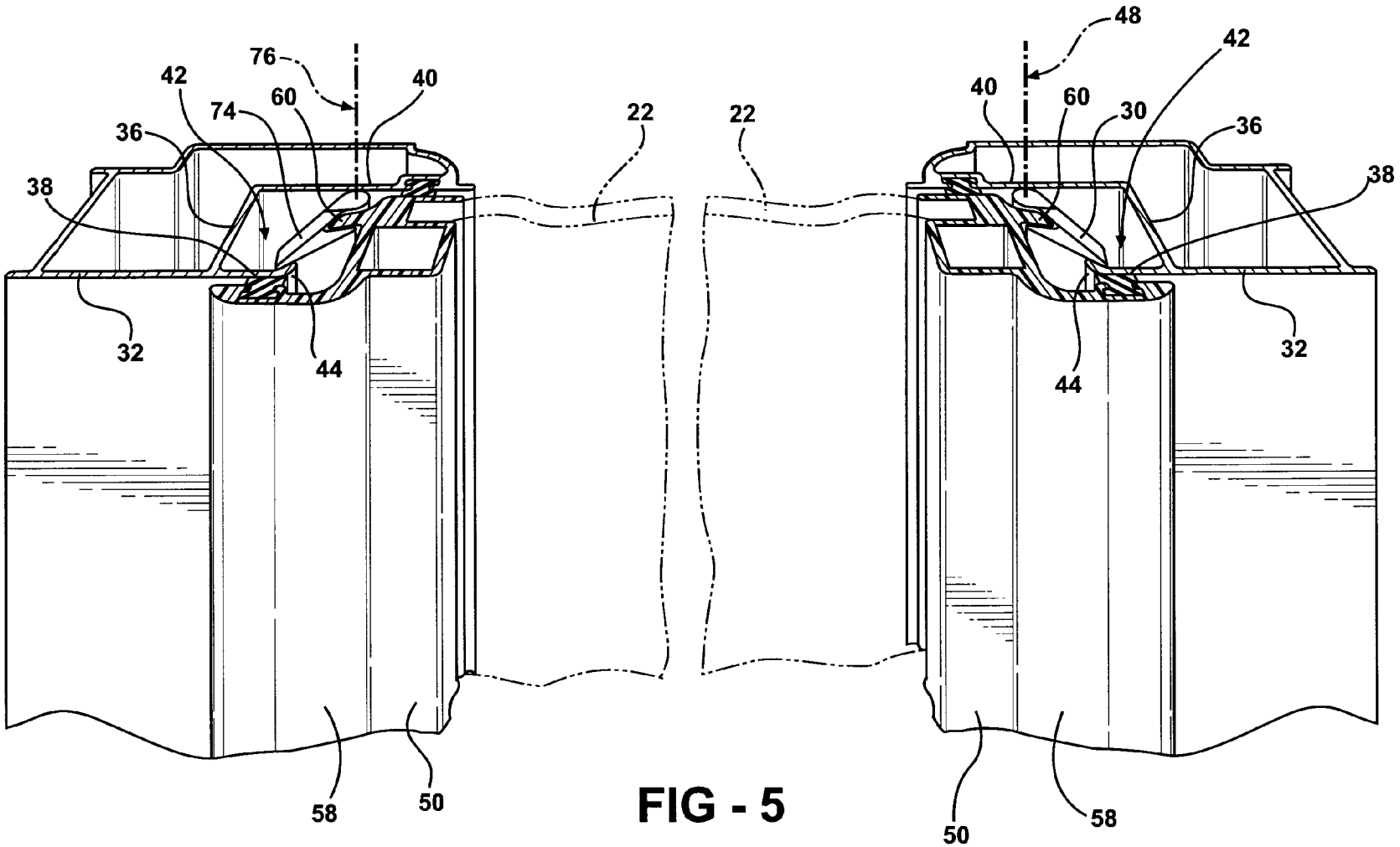
FIG. 5 is a cross-sectional view of the pair of retention assemblies.

Referring to FIGS. 3-5, the locking latch 30 is disposed in the cavity 42 and extends along the locking axis 48 in spaced and parallel relationship to one of the first segments 32. Preferably, a second locking latch 74 is disposed in the cavity 42 for the other one of the first segments 32. The second locking latch 74 extends along the respective axis 48, which is a second locking axis 76, in spaced and parallel relationship to the other one of the first segments 32, as shown in FIG. 5. However, it should be appreciated that the second locking latch 74 is not required.

Referring to FIGS. 8 and 9, the locking latch 30 includes a rod portion 78 which extends between ends 79 and along the axis 48. An arm portion 80 extends from the rod portion 78 and between the ends 79. The ends 79 are rotatably supported by at least one of the pivot holes 49 or slots 51 in the surround 24 for locking engagement between the locking latch 30 and the catch 60 when the locking latch 30 is rotated about the axis 48. A pin 82 extends from each end 79 of the locking latch 30 on the axis 48 where the pins 82 are rotatably supported by the respective pivot hole 49 in the base wall 36 of the second segment 34. Alternatively, if slots 51 are used, the pins 82 are slidably support, and may also be rotatably supported, by the respective slot 51. The pins 82, which have a generally round shape, extend from the rod portion 78. However, the pins 82 are not limited to being round, but may be any desired shape, e.g., tear-drop shaped, etc. The rod portion 78 is a generally round shaped rod and one pin 82 extends from the rod portion 78 at each of the ends 79. The rod portion 78 is not limited to being round, but may be any desired shape. If only one pin 82 is used, the pin 82 will extend from only one of the ends 79. Therefore, the pins 82 are rotatably supported by the pivot holes 49. When the locking latch 30 is rotated about the axis 48, the pins 82 rotate within the pivot holes 49.

The locking latch 30 also includes a latch portion 84 which extends from the arm portion 80. The arm portion 80 and the latch portion 84 define a retention recess 86 for locking engagement with the respective catch 60. The cross-section of the arm portion 80 has a generally trapezoidal shape and the latch portion 84 is generally fin shaped. Overall, the locking latch 30 presents a cross-section having a general arrowhead shape. The latch portion 84 includes a locking surface 85 which extends from the arm portion 80 to a tip 87. Therefore, the locking surface 85 and the arm portion 80 defined the retention recess 86. The latch portion 84 also includes a sliding surface 89 which extends from the arm portion 80 to the tip 87. The locking surface 85 is for engaging the retention surface 61 of the respective catch 60. The ramp surface 63 of the respective catch 60 slides along the sliding surface 89 of the locking latch 30 to rotate the locking latch 30 about the axis 48. Preferably, the retention recess 86 is V-shaped. However, the retention recess 86 may be any desired shape which facilitates engagement of the catch 60. The catch 60 curves from the floor 54 for engaging the V-shaped retention recess 86. This means that when the locking latch 30 is rotated about the axis 48, the locking latch 30 is stopped by, and becomes disposed against, the catch 60. Additionally, as the locking latch 30 rotates about the axis 48, the retention lip 44 acts as another stop as the latch portion 84, near the tip 87, comes into contact with the retention lip 44. This also limits rotation of the locking latch 30 about the axis 48 which prevents the locking latch 30 from rotating into the opening 26 in the absence of a frame 28, which would complicate assembly of the frame 28 to the surround 24. It should be appreciated that the description of the locking latch 30 above is also applicable to the second locking latch 74 and the second axis 76.

Alternatively, the pins 82 are not required as any other configuration may be used such that the ends 79 are still rotatably supported by the pivot holes 49 in the surround 24. For example, the ends 79 define the pivot hole 49 and the surround 24 includes the pin 82 where the pin 82 engages the pivot hole 49 and the ends 79 are rotatably supported by the pivot holes 49. Alternatively, the pins 82 are not round, but are any other shape which is secured to the pivot holes 49 or slots 51 of the surround 24 such that the pins 82 do not rotate or slide with respect to the pivot holes 49 or slots 51. In this embodiment, the locking latch 30 is formed from a resilient material such that the latch portion 84, the arm portion 80, and/or the rod portion 78 flex and rotate about the axis 48 with respect to the ends 79 in response to the application of a load to the locking latch 30 while the pins 82 remain fixed relative to the surround 24. Because the locking latch 30 is formed from the resilient material, the latch portion 84, the arm portion 80, and/or the rod portion 78 return from the flexed portion to a relaxed position in the absence of the load.

The catch 60 of the first side 50 and the support wall 68 of the first segment 32 define a pivot pocket 88 therebetween. The axis 48 extends along the pivot pocket 88 and the rod portion 78 of the locking latch 30 is disposed in the pivot pocket 88. A biasing device 90 is disposed between one the first segments 32 and the locking latch 30 for biasing the locking latch 30 about the axis 48 to engage the catch 60 and rest against the retention lip 44. If the second locking latch 74 is used, a second biasing device 92 is disposed between the other one of the first segments 32 and the second locking latch 74. Preferably, there are a plurality of biasing devices 90, 92 disposed between the first segments 32 and the respective locking latches 30, 74. The biasing device 90 is a leaf spring 94 or anything else which exerts a force by biasing the locking latch 30 about the axis 48, such as a resilient component. The resilient component may be formed from any type of resilient material which is compressible between an uncompressed condition and a compressed condition for biasing the locking latch and imparting a biasing force, i.e., "biasing", against the locking latch 74 as the resilient material returns to its original shape. The resilient component can be a foamed or non-foamed component manufactured from chemicals which result in resiliency including, but not limited to, natural rubbers, synthetic rubbers, urethanes, and the like. However, the resilient component may also may be formed from any type other type of material, or material combination, which imparts the biasing force as the resilient component returns to its original shape. The leaf spring 94 typically includes a strip that is arched and has a peak 96 at a midpoint (not numbered) of the strip. The strip extends between opposing feet 98. The feet 98 and the peak 96 react between the base wall 36 and the latch portion 84 of the locking latch, opposite the retention recess 86. Therefore, the biasing device 90 reacts between the locking latch 30 and the first segment 32. This causes the locking latch 30 to pivot within the pivot pocket 88, about the axis 48, so that the catch 60 extends into, and is retained by, the retention recess 86 while the latch portion 84 stops against the retention lip 44. Alternatively, if the slots 51 are defined instead of the pivot holes 49, the biasing device 90 causes the locking latch 30 to slide along the slots 51 relative to the respective first segment 32 and toward the opening 26. This movement allows the catch 60 to extend into, and be retained by, the retention recess 86 while the latch portion 84 stops against the retention lip 44. When the slots 51 are defined in the surround 26, the locking latch 30 may pivot about the axis 48 in addition to sliding relative to the respective first segment 32. It should be appreciated that the biasing device 90 may react between any wall 36, 38, 40 of the first segment 32 and the locking latch 30 as long as the biasing device 90 causes the locking latch 30 to pivot about the axis 48 and/or slide along the slots 51 relative to the respective first segment 32. With the biasing devices 90 reacting against opposing base walls 36, facing the opening 26, each locking latch 30 is biased, in opposite directions, toward the opening 26. By biasing each locking latch 30, 74 and the respective first side 50 of the frame 28 toward the opening 26, the first sides 50 are spaced from the first segments 32 such that the frame 28 "floats" between the first segments 32 of the surround 24. This helps prevent the frame 28 from rattling with respect to the surround 24 when the frame 28 is secured across the opening 26.

Alternatively, the locking latch 30 is used with the second locking latch 74, which is non-functional, i.e., stationary. Therefore, in this embodiment, the second biasing device 92 is not required. This means that the second locking latch 74 does not pivot or slide with respect to the surround 24. However, the second locking latch 74 in this embodiment would still include the latch portion 84 and the arm portion 80 which define the retention recess 86. When the non-functional second locking latch 74 is used, the second locking latch 74 remains stationary with respect to the surround 24. The locking latch 30 and biasing device 90, which are functional, are disposed between the first segments 32. The biasing device 90 reacts between one of the base walls 36 and the locking latch 30. This causes the locking latch 30 to pivot within the pivot pocket 88, about the axis 48, or slide within the slot 51, so that the catch 60 extends into the retention recess 86 and the latch portion 84 stops against the retention lip 44. With the biasing device 90 reacting against only one of the base walls 36, which faces the opening 26, the locking latch 30 is biased toward the opening 26. By biasing the locking latch 30 and the respective first side 50 of the frame 28 toward the opening 26, the other first side 50, and the respective catch 60, are biased against the non-functional second locking latch 74 so that the catch 60 extends into the retention recess 86 and the latch portion 84 stops against the retention lip 44 of the second locking latch 74 to secure the frame 28 across the opening 26 of the surround 24.

As another alternative, only one locking latch 30 and one biasing device 90 are disposed between the first segments 32. When the second locking latch 74 and second biasing device 92 are not used, the biasing device 90 reacts between one of the base walls 36 and the respective locking latch 30. This causes the locking latch 30 to pivot within the pivot pocket 88, about the axis 48, or slide relative to the respective first segment 32, so that the catch 60 extends into the retention recess 86 and the latch portion 84 stops against the retention lip 44. With the biasing device 90 reacting against only one of the base walls 36, the locking latch 30 is biased toward the opening 26. By biasing the locking latch 30 and the respective first side 50 of the frame 28 toward the opening 26, the other first side 50 is biased against the other one of the first segments 32 to secure the frame 28 across the opening 26 of the surround 24. In this embodiment, seals 64, 70 are preferably used to prevent rattling or scraping between the other first side 50 and the other first segment 32.

The frame 28 is attached to the surround 24 by presenting the frame 28 to the opening 26 of the surround 24, as shown in FIG. 7. The ramp surface 63 of the catch 60 for the first sides 50 is pushed against the latch portion 84 of the locking latch 30 which causes the locking latch 30 to pivot about the axis 48. As the locking latch 30 pivots about the axis 48, the catch 60 eventually slides off of the latch portion 84 and toward the retention recess 86 of the locking latch 86. The force exerted by the biasing device 90 on the locking latch 30 then biases the locking latch 30 back toward the catch 60 to trap the catch 60 in the retention recess 86. The retention surface 61 of the catch 60 rests against, and is retained by, the locking surface 85 of the locking latch 30. This means that the side 50 becomes trapped between the retention recess 86 and the mounting wall 40. These steps are repeated to attach the other first side 50 to the other one of the first segments 32 and the second locking latch 74. Alternatively, both of the first sides 50 are assembled to the respective first segments 32 and the respective locking latch 30, 74 at the same time by centering the frame 28 across the opening 26 and pushing the sides 50 of the frame 28 until both locking latches 30, 74 lock onto the respective catches 60. In either case, FIG. 3 illustrates the frame 28 when it is fully attached to the surround 24. To remove the frame 28 from the surround 24, one of the first sides 50 are pushed or slid toward one of the first segments 32 until the catch 60 becomes disengaged from the retention recess 86 of the locking latch 30 at the other one of the first segments 32. Once the catch 60 becomes disengaged from the retention recess 86, the respective first side 50 is pulled out and away from the respective first segment 32 and the respective locking latch 74. Then, the entire frame 28 is removed from the surround 24.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A retention assembly for retaining a panel in a window or a door, said retention assembly comprising:

a surround including a pair of first spaced segments extending in spaced and parallel relationship and a pair of second spaced segments with said first segments extending relative to said second segments to define an opening;

a frame for supporting the panel and including a pair of first spaced sides extending in spaced and parallel relationship for disposition of said frame within said first and second pair of segments, one of said first sides of said frame presenting a cross-section including a floor and a catch extending from said floor;

a locking latch including an engagement portion engaged with said surround and a latch portion spaced from said engagement portion said locking latch defining a retention recess for receiving said catch for locking engagement between said catch and said locking latch when said locking latch is moved toward said catch and for releasing said catch when said locking latch is moved away from said catch, said surround retaining said locking latch when said locking latch is released from said catch; and a biasing device disposed between said surround and said locking latch for biasing said locking latch relative to said surround;

wherein said surround defines a cavity housing said locking latch; and wherein said surround has a retention lip with said locking latch disposed between said biasing device and said retention lip, said biasing device biasing said latch portion against said retention lip in said cavity with said latch portion contacting said retention lip of said surround and contacting said catch of said frame.

2. A retention assembly as set forth in claim 1 wherein said latch portion extends away from said engagement portion for engaging said catch with said engagement portion movably supported and retained by said surround.

3. A retention assembly as set forth in claim 2 wherein said latch portion includes a locking surface extending to a tip defining said retention recess and wherein said latch portion includes a sliding surface extending to said tip.

4. A retention assembly as set forth in claim 3 wherein said catch includes a retention surface extending from said floor to a point and a ramp surface extending from said floor to said point with said ramp surface adapted to slide along said sliding surface of said locking latch and said retention surface adapted to rest against said locking surface to retain said catch to said locking latch when said catch is disposed in said retention recess.

5. A retention assembly as set forth in claim 2 wherein said engagement portion defines a pin and wherein said surround defines an aperture receiving said pin for moveably supporting said locking latch.

6. A retention assembly as set forth in claim 1 wherein said lip bends into said cavity.

7. A retention assembly as set forth in claim 6 wherein said latch portion includes a locking surface extending to a tip defining said retention recess and wherein said latch portion includes a sliding surface extending to said tip.

8. A retention assembly as set forth in claim 7 wherein said catch includes a retention surface extending from said floor to a point and a ramp surface extending from said floor to said point with said ramp surface adapted to slide along said sliding surface of said locking latch and said retention surface adapted to rest against said locking surface to retain said catch to said locking latch when said catch is disposed in said retention recess.

9. A retention assembly as set forth in claim 1 wherein said biasing device biases said locking latch against said frame.

10. A retention assembly for retaining a panel in a window or a door, said retention assembly comprising:

a surround defining an opening;

a frame removeably engageable with said surround for supporting the panel in said opening; and a locking latch including a rod portion moveably engaged with and retained in said surround and a latch portion spaced from said rod portion for engaging said frame;

said frame including a floor and a catch extending from said floor for engaging said locking latch; and said surround defining a cavity housing said locking latch and wherein said surround has a retention lip, said latch portion being in contact with said retention lip in said cavity and in contact with said catch of said frame.

11. A retention assembly as set forth in claim 10 further comprising a biasing device disposed between said surround and said locking latch for biasing said locking latch relative to said surround.

12. A retention assembly as set forth in claim 11 wherein said locking latch is disposed between said biasing device and said retention lip.

13. A retention assembly as set forth in claim 12 wherein said biasing device biases said locking latch against said surround.

14. A retention assembly as set forth in claim 11 wherein said biasing device biases said locking latch against said surround.

15. A retention assembly as set forth in claim 10 wherein said latch portion defines a retention recess receiving said catch for locking engagement between said catch and said locking latch when said locking latch is moved toward said catch and for releasing said catch when said locking latch is moved away from said catch.

16. A retention assembly as set forth in claim 10 wherein said lip bends into said cavity.

17. A retention assembly as set forth in claim 10 wherein said biasing device biases said locking latch against said frame.

18. A retention assembly for retaining a panel in a window or a door, said retention assembly comprising:

a surround defining an opening;

a frame removeably engageable with said surround for supporting the panel in said opening;

a locking latch including a rod portion moveably engaged with said surround and a latch portion spaced from said rod portion for engaging said frame;

said frame including a floor and a catch extending from said floor for engaging said locking latch; and a biasing device disposed between said locking latch and said surround and urging said latch portion toward said catch to engage said frame in said surround;

said surround having a retention lip with said latch portion of said locking latch disposed between said biasing device and said retention lip, said biasing device biasing said latch portion against said retention lip, said latch portion being in contact with said retention lip of said surround and in contact with said catch of said frame.

19. A retention assembly as set forth in claim 18 wherein said surround defines a cavity housing said locking latch and said biasing device and wherein said retention lip extends along said cavity.

20. A retention assembly as set forth in claim 19 wherein said biasing device biases said locking latch against said retention lip in said cavity.

21. A retention assembly as set forth in claim 18 wherein said rod portion is retained in said surround.

22. A retention assembly as set forth in claim 18 wherein said latch portion includes a locking surface extending to a tip and defining said retention recess and wherein said latch portion includes a sliding surface extending to said tip.

23. A retention assembly as set forth in claim 22 wherein said catch includes a retention surface extending from said floor to a point and a ramp surface extending from said floor to said point with said ramp surface adapted to slide along said sliding surface of said locking latch and said retention surface adapted to rest against said locking surface to retain said catch to said locking latch when said catch is disposed in said retention recess.

24. A retention assembly as set forth in claim 18 wherein said lip bends into said cavity.

25. A retention assembly as set forth in claim 18 wherein said biasing device biases said locking latch against said frame.

26. A retention assembly for retaining a panel in a window or a door, said retention assembly comprising:

a surround defining an opening;

a frame removeably engageable with said surround inside said opening for supporting said panel in said opening;

said frame including a floor and a catch extending from said floor;

a locking latch movably supported by said surround and including a recess for receiving said catch; and a resilient biasing device disposed between said locking latch and said surround and urging said locking latch toward said catch to engage said frame in said surround;

said surround having a retention lip with said locking latch disposed between said biasing device and said retention lip, said biasing device biasing said locking latch against said retention lip.

* * * * *